US009552709B2

(12) United States Patent
Beaurepaire et al.

(10) Patent No.: US 9,552,709 B2
(45) Date of Patent: Jan. 24, 2017

(54) METHOD APPARATUS AND COMPUTER PROGRAM

(71) Applicant: HERE Global B.V., Veldhoven (NL)

(72) Inventors: Jerome Beaurepaire, Berlin (DE); Marko Tuukkanen, Schlenzer (DE)

(73) Assignee: HERE GLOBAL B.V., Eindhoven (NL)

( * ) Notice: Subject to any disclaimer, the term of this patent is extended or adjusted under 35 U.S.C. 154(b) by 0 days.

(21) Appl. No.: 14/563,306

(22) Filed: Dec. 8, 2014

(65) Prior Publication Data

US 2015/0170491 A1 Jun. 18, 2015

(30) Foreign Application Priority Data

Dec. 13, 2013 (GB) ..... 1322060.3

(51) Int. Cl.
*G08B 13/14* (2006.01)

(52) U.S. Cl.
CPC ..... *G08B 13/1481* (2013.01); *G08B 13/1436* (2013.01); *G08B 13/1427* (2013.01)

(58) Field of Classification Search
CPC ..... G08B 13/1436; G08B 13/1472; G08B 13/1481; G08B 13/14; G01P 15/00; H04N 13/02; H04N 13/0242; H04N 13/025
USPC ..... 340/521, 539.11, 539.21, 540, 573.3, 340/669; 73/488, 514.01; 348/47
See application file for complete search history.

(56) References Cited

U.S. PATENT DOCUMENTS 6,674,358 B1 1/2004 Tinsley
6,940,407 B2 * 9/2005 Miranda-Knapp G08B 13/1418 340/539.13
7,180,425 B2 * 2/2007 Yuasa ..... G01P 1/127 340/669
7,583,972 B2 * 9/2009 Clipsham ..... G08B 1/08 455/418
8,044,818 B2 * 10/2011 Tysowski ..... G08B 21/24 340/540
8,164,471 B2 * 4/2012 Yang ..... G01P 3/50 340/539.13
2004/0070499 A1 4/2004 Sawinski
2006/0070439 A1 * 4/2006 Kwon ..... G01P 15/00 73/488
2009/0102665 A1 4/2009 Baranowski et al.
(Continued)

FOREIGN PATENT DOCUMENTS

CN 202320602 U 7/2012
CN 102750803 A 10/2012
(Continued)

OTHER PUBLICATIONS

"Hot Watch:Complete Smart Watch W/revolutionary Private Calls", Kickstarter, Retrieved on Feb. 6, 2015, Webpage available at : https://www.kickstarter.com/projects/hotsmartwatch/hot-watch-complete-smart-watch-w-revolutionary-pri-0.
(Continued)

*Primary Examiner* — Hung T Nguyen
(74) *Attorney, Agent, or Firm* — Alston & Bird LLP

(57) ABSTRACT

Examples of the present disclosure provide a method, apparatus and computer program configured to cause performance of the following: detecting movement of a device; detecting at least one ambient condition of the device; and determining whether to trigger an alert in dependence upon the detected movement and the detected at least one ambient condition.

18 Claims, 5 Drawing Sheets

(56) References Cited

U.S. PATENT DOCUMENTS

| | | | | |
|---|---|---|---|---|
| 2009/0267762 | A1* | 10/2009 | Shyu | G08B 21/24 340/540 |
| 2011/0215925 | A1 | 9/2011 | Chen et al. | |

FOREIGN PATENT DOCUMENTS

| | | | |
|---|---|---|---|
| EP | 0103375 | A1 | 3/1984 |
| EP | 2211319 | A1 | 7/2010 |
| EP | 2472410 | A1 | 7/2012 |
| WO | 2012/113536 | A1 | 8/2012 |

OTHER PUBLICATIONS

"Medical Alert Monitoring for Seniors Ibrick House Alert", Nita's Random Thoughts, Retrieved on Feb. 6, 2015, Webpage available at : http://www.nitasrandomthoughts.info/2009/09/medical-alert-monitoring-for-seniors-brick-house-alert.html.

Search Report received for corresponding United Kingdom Patent Application No. 1322060.3, dated Jun. 6, 2014, 4 pages.

* cited by examiner

METHOD APPARATUS AND COMPUTER PROGRAM

TECHNOLOGICAL FIELD

Examples of the present disclosure relate to a method, apparatus and computer program for determining to trigger an alert. In particular, though without prejudice to the foregoing, certain particular examples relate to a method, apparatus and computer program for alerting a user of unintentional movement of a device, such as for example the device falling out of the user's pocket.

BACKGROUND

A user, when not actively using a device such as a hand portable electronic device (e.g. a mobile/smart phone, wireless communications device, media player, PDA . . . ) would typically carry the device on their person by placing it in a pocket. Conventional portable devices are not always optimal with regards to reducing the risk of the device being misplaced, lost or stolen due to movement of the device, such as the device falling out of a user's pocket onto a chair.

The listing or discussion of any prior-published document or any background in this specification should not necessarily be taken as an acknowledgement that the document or background is part of the state of the art or is common general knowledge. One or more aspects/examples of the present disclosure may or may not address one or more of the background issues.

BRIEF SUMMARY

According to at least some examples of the disclosure there is provided a method comprising causing at least in part, actions that result in:

detecting movement of a device;

detecting at least one ambient condition of the device; and determining whether to trigger an alert in dependence upon the detected movement and the detected at least one ambient condition.

According to at least some examples of the disclosure there is provided an apparatus, a chipset, a module or a device comprising means configured to cause the above method to be performed.

According to at least some examples of the disclosure there is provided a computer program that, when performed by at least one processor, causes the above method to be performed.

According to at least some examples of the disclosure there is provided an apparatus comprising: at least one processor; and at least one memory including computer program code; the at least one memory and the computer program code configured to, with the at least one processor, cause the apparatus at least to perform:

detecting movement of a device;

detecting at least one ambient condition of the device; and determining whether to trigger an alert in dependence upon the detected movement and the detected at least one ambient condition.

According to at least some examples of the disclosure there is provided a non-transitory computer readable medium encoded with instructions that, when performed by at least one processor, causes at least the following to be performed:

detecting movement of a device;

detecting at least one ambient condition of the device; and determining whether to trigger an alert in dependence upon the detected movement and the detected at least one ambient condition.

BRIEF DESCRIPTION OF THE DRAWINGS

For a better understanding of various examples that are useful for understanding the detailed description reference will now be made by way of example only to the accompanying drawings in which.

DETAILED DESCRIPTION

Figure 1:
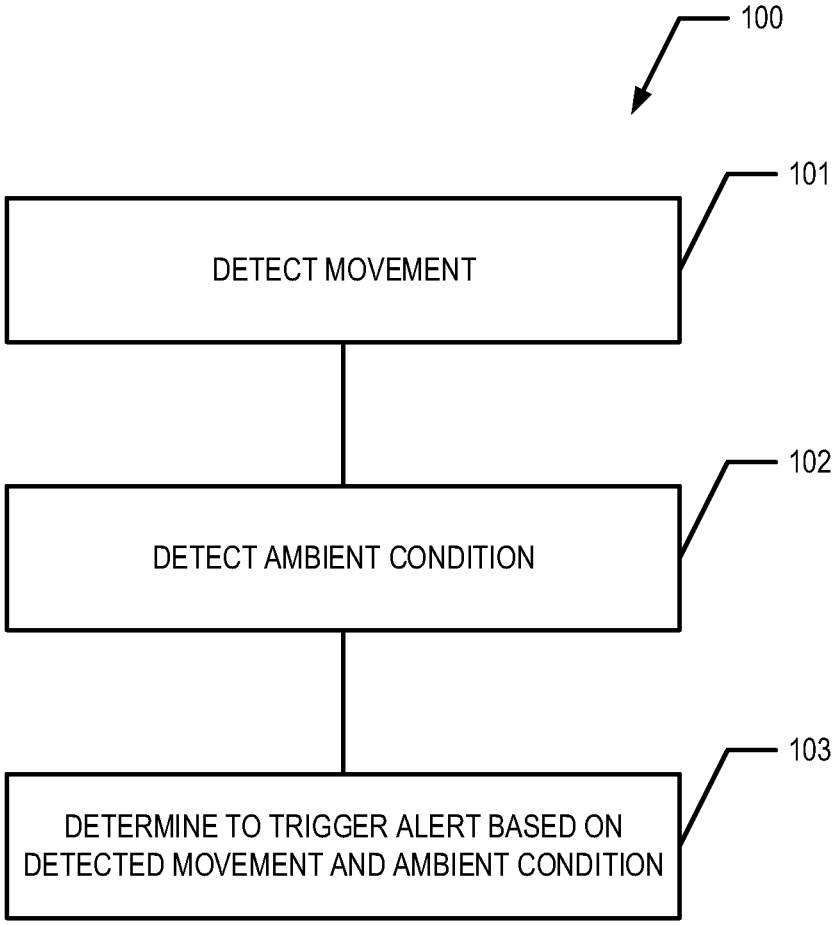
FIG. 1 schematically illustrates a method according to an example of the disclosure.

Examples of a method, apparatus and computer program will now be described with reference to the Figures. Where appropriate similar reference numerals are used in the Figures to designate similar features. For clarity, all reference numerals are not necessarily displayed in all figures.

FIG. 1 schematically illustrates a flowchart of a method 100 according to an example of the disclosure. The component blocks of FIG. 1 are functional and the functions described may or may not be caused to be performed by a single physical entity (such as the apparatus 200 of FIG. 2 or the device 210, 410 of FIGS. 2 and 4).

The method 100 comprises causing at least in part, actions that result in:

detecting 101 movement of a device 210;

detecting 102 at least one ambient condition of the device 210; and determining 103 whether to trigger an alert in dependence upon the detected movement and the detected at least one ambient condition.

As discussed in further detail below and with respect to FIG. 2, the method may be caused to be performed by a controller 201 of an apparatus 200 which controls and receives signals from one or more detectors/sensors 208*a*, 208*b* that are configured to detect movement of the device and at least one ambient condition.

The detection of movement block 101 may comprise detecting whether a movement of the device meets a particular criterion such as detection of a movement of the device greater than a certain threshold. For example a detected: displacement, change in orientation and/or change in acceleration being greater than a threshold amount. The criterion may comprise a particular profile of movement or a particular sequence of detected movements determined to be indicative of unintentional movement for which an alert should be triggered. For example: an acceleration in one direction (device falling down) followed by an abrupt change of acceleration (device landing/impacting on surface).

The criterion may also be whether or not the movement occurred whilst a user was in contact with the device. In certain examples, the device may comprise a touch, grip or holding sensor or other detection mechanism that can detect whether or not a user is holding, gripping or touching the device. The detection of movement block 101 may be caused to occur only when it is determined that a user is not in direct physical contact with the device. Such movement when the user is not holding the device can be considered to be indicative of unintentional movement for which an alert should be triggered.

The mere detection of movement alone may not be sufficient to ascertain whether or not an alert ought to be triggered. For example, distinguishing between subtle movements of a device within a user's trouser pocket whilst a user is sitting on a seat, and the movement of a device gently falling from the user's pocket onto the seat. Accordingly, examples of the disclosure additionally detect at least one ambient condition in block 102 and use the same in determining whether or not to trigger an alert in block 103.

The ambient condition is a generic term that encompasses, for example, at least the following examples: a light/luminosity level, a sound level, a temperature, an orientation of the device, a proximity of an object to the device, whether or not a user is touching the device, a coupling state between the device and another device, and a separation distance between the device and another device.

Such ambient conditions can provide an indication as to whether the detected movement is intentional or not. For example, where a device accidently falls out of a user's pockets:

- a detected ambient light level may change from a low level (dark inside pocket) to a higher level (lighter outside pocket),
- a detected ambient sound level may change from a low level (quiet inside pocket) to a higher level (louder ambient noise outside pocket),
- a detected ambient temperature may change from being in the region of body temperature, i.e. approximately 37 degrees, inside the pocket to an ambient room temperature, i.e. 21 degrees Celsius, outside pocket,
- a detected ambient humidity may change from one level when inside the pocket to a different level when outside the pocket, e.g. a humidity/perspiration sensor detecting a decrease in humidity/perspiration level when the device is no longer proximal to a user's leg when in the pocket,
- a detected ambient level of one or more gases or particles may change, e.g. a smoke sensor detecting an increase in smoke levels where the device falls out of the pocket when in a smoky bar, or a particle/smell sensor detecting a change in ambient particles odours where the device falls out of the pocket when in a restaurant,
- a detected pressure/force imparted on the device may change from one level, when the device is pressed against a user's legs when in the pocket, to a lower pressure when no longer in the pocket,
- a detected orientation may change from a major axis of the device being vertically aligned inside the pocket to horizontally alighted outside of the pocket having fallen onto a surface,
- a detected proximity may change from detecting a proximal object (pocket lining) when inside the pocket and no proximal object when outside of the pocket,
- a grip sensor may detect that a user is not touching the device,
- a detected coupling state of the device to another device may change from an attached/connected state when inside to pocket to a detached/disconnected, e.g. physical disconnection of a peripheral device such as headphones wherein the jack pulled out from device during fall) or wireless disconnection where a short range wireless connection is lost following fall,
- a detected separation distance between the device and another device may increase following a fall.

The ambient condition detection in block 102 may occur substantially simultaneously/contemporaneously with the detection of movement in block 102. Additionally, a reference ambient condition could be detected prior to the detection of movement in block 102.

The detection in block 102 may be caused to be performed in response to the detection of a movement or the detected movement meeting a criterion. For example, where the detected movement is a change in orientation indicative that the device is lying front face down (e.g. see FIG. 5C) the controller could activate a particular detector located on a rear face to detect an ambient condition. Activating a detector and detecting an ambient condition therefrom in response to the detection of movement advantageously reduces power consumption by only operating the detector when required.

Various combinations of the above mentioned ambient conditions may be used to ascertain whether the movement was a deliberate movement by the user or the result of an unintentional movement for which an alert to inform the user of the same ought to be triggered.

The determining block 103 may comprise determining whether or not the detected movement of block 101 meets a criterion and/or whether the detected at least one ambient condition meets a criterion.

Where two or more detected ambient conditions are used, the two or more ambient conditions can be differently weighted. For example, the detected sound level may have a lower weighting factor in the determination block 103 than the determination that a user is holding the device.

Examples of the present disclosure enable a distinction between movements, in particular subtle movements where the device does not undergo a large/distinctive acceleration or impact. Advantageously, the use of at least one detected ambient condition, in addition to the detected movement, in determining to trigger an alert 103 provides an improved ability to distinguish between different types of movement and ascertain whether or not the movement was likely to have been intentional or not and hence whether an alert ought to be triggered.

Being able to distinguish between different types of movement assists determining whether a particular movement merits the triggering of an alert, i.e. it helps ascertain whether a movement was unintentional, such as falling out of a user's pocket (c.f. intentional movement of a user deliberately removing the device from a user's pocket).

Accordingly, certain examples advantageously enable the triggering of an alert based on unintentional movement of a device thereby reducing the risk of the device being misplaced, lost or stolen due to movement of the device, such as the device falling out of a user's pocket.

The flowchart of FIG. 1 represents one possible scenario among others. The order of the blocks shown is not absolutely required, so in principle, the various blocks can be performed out of order. For example blocks 101 and 102 may be performed: in a different order or overlapping in time, in series or in parallel.

Examples of the invention may take the form of a method, an apparatus or a computer program. Accordingly, examples may be implemented in hardware, software or a combination of hardware and software.

Examples of the invention are described in the present disclosure using flowchart illustrations and schematic block diagrams. It will be understood that each block (of the flowchart illustrations and block diagrams), and combinations of blocks, can be implemented by computer program instructions of a computer program. These program instructions may be provided to one or more processor(s), processing circuitry or controller(s) such that the instructions which execute on the same create means for causing implementing the functions specified in the block or blocks. The computer program instructions may be executed by the processor(s) to cause a series of operational steps to be performed by the processor(s) to produce a computer implemented process such that the instructions which execute on the processor(s) provide steps for implementing the functions specified in the block or blocks.

Accordingly, the blocks support: combinations of means for performing the specified functions; combinations of steps for performing the specified functions; and computer program instructions for performing the specified functions. It will also be understood that each block, and combinations of blocks, can be implemented by special purpose hardware-based systems which perform the specified functions or steps, or combinations of special purpose hardware and computer program instructions.

Figure 2:
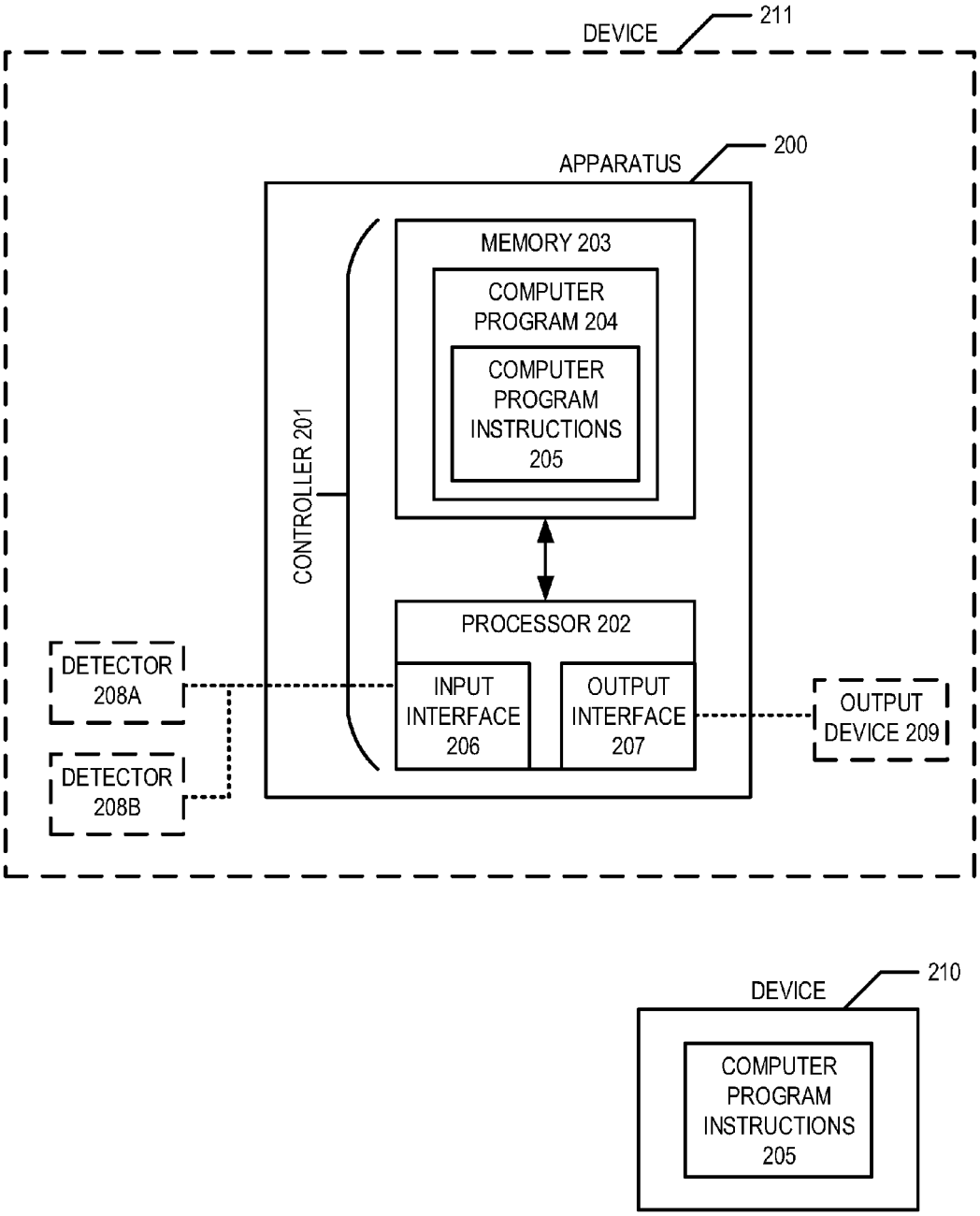
FIG. 2 schematically illustrates an apparatus according to an example of the disclosure.
Figure 3:
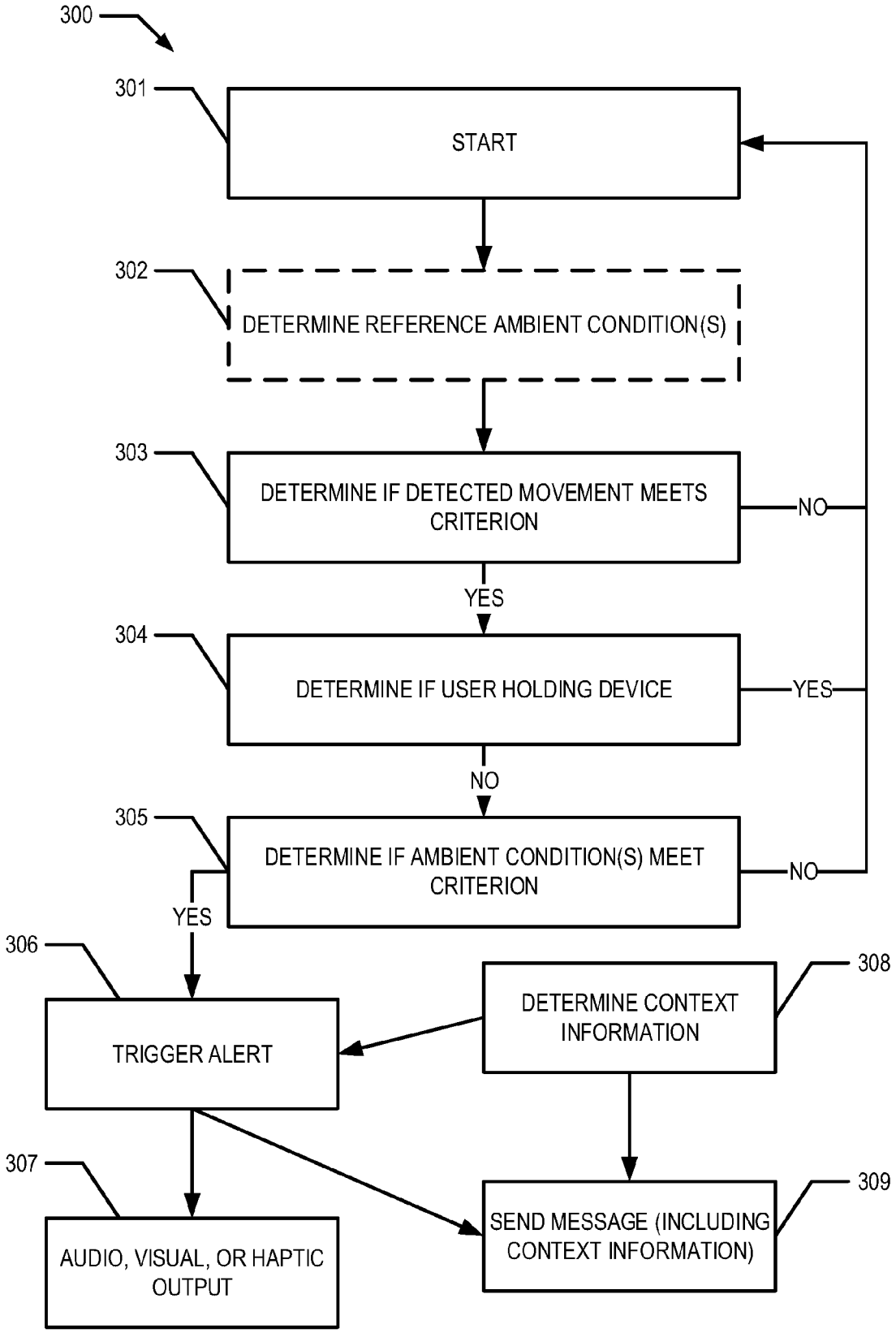
FIG. 3 schematically illustrates a flow chart according to an example of the disclosure.

FIG. 2 schematically illustrates an apparatus 200 configured to cause the performance of methods described in the present disclosure, not least those of FIGS. 1 and 3. FIG. 2 focuses on the functional components necessary for describing the operation of the apparatus.

The apparatus 200 comprises a controller 201. Implementation of the controller 201 can be in hardware alone (e.g. processing circuitry 202 comprising one or more processors and memory circuitry 203 comprising one or more memory elements), have certain aspects in software including firmware alone or can be a combination of hardware and software (including firmware).

The controller 201 may be implemented using instructions that enable hardware functionality, for example, by using executable computer program instructions 205 in a general-purpose or special-purpose processor 202 that may be stored on a computer readable storage medium 210 (disk, memory etc.) or carried by a signal carrier to be executed by such a processor.

In the illustrated example, the controller 201 is provided by a processor 202 and memory 203. Although a single processor and a single memory are illustrated in other implementations there may be multiple processors and/or there may be multiple memories some or all of which may be integrated/removable and/or may provide permanent/semi-permanent/dynamic/cached storage.

The processor 202 is configured to read from and write to the memory 203. The processor 202 may also comprise an input interface 206 via which signals, data and/or commands (e.g. signals from detectors 208*a*, 208*b*) are input to the processor 202, and an output interface 207 via which signals, data and/or commands (e.g. to the detectors 208*a*, 208*b* regarding causing the various detections, and/or an output device 209 to output an alert) are output by the processor 202.

The memory 203 stores a computer program 204 comprising computer program instructions 205. The instructions control the operation of the apparatus 200 when loaded into the processor 202. The processor 202 by reading the memory 203 is able to load and execute the computer program 204. The computer program instructions 205 provide the logic and routines that enables the apparatus 200 to perform the methods described illustrated in the flow charts of FIGS. 1 and 3.

The computer program may arrive at the apparatus 200 via any suitable delivery mechanism. The delivery mechanism may be, for example, a computer-readable storage medium 210, a computer program product, a memory device, a record medium, an article of manufacture that tangibly embodies the computer program 204. The delivery mechanism may be a signal configured to reliably transfer the computer program 204. The apparatus 200 may receive the computer program 204 as a computer data signal.

The apparatus 200 may be a part of the device 211 (as shown in dotted outline) for which movement and ambient conditions are detected. The device 211 may also comprise detectors/sensors or other means for detecting the device's movement and ambient conditions 208*a*, 208*b*. Alternatively, the apparatus and the detectors may be separate and remote from the device. The apparatus may also be separate from the sensors but able to control the sensors and receive signals therefrom, e.g. send commands via output interface 207 and receive measurements via input interface 206.

The at least one detector 208*a* for detecting movement of the device may be by any appropriate detector, sensor, mechanism or means configured to detect movement or enabling determination of the same, e.g. determining a change in position or orientation. Such detectors may include but are not limited to:

- means for detecting acceleration such as accelerometers,
- means for detecting relative/absolute position such as position sensors, proximity sensors or GPS,
- means for detecting orientation such as gyroscopic or magnetic based sensors.

The at least one ambient condition of the device may comprise external environmental factors/conditions such as: a light level, a sound level and a temperature. Such ambient conditions could be detected by any suitable light/sound/temperature/humidity/gas/particle/pressure detector or sensor.

Alternatively, or in addition, the at least one ambient condition may be an ambient condition/state related to the device such as: an orientation of the device, a proximity of an object to the device, whether or not a user is touching the device, a coupling state between the device and another device, and a separation distance between the device and another device.

Detection of such conditions may be via any suitable detector, sensor or mechanism. For example, one or more sensors 208*b* may comprise:

- one or more gyroscopes configured to detect an orientation of the device with respect to one or more axes,
- a proximity detector able to detect presence or absence of an object in a particular direction of the device and within a short range of the device, for example of the order of several centimeters or tens of centimeters of the device,
- mechanical or electrical means for sensing whether or not a user is touching the device, e.g. a contact switch located at user contact points where a user typically holds the device in use, to detect whether the user is holding the device or a capacitive touch sensor for sensing a user's physical touch upon the device.
- a wireless receiver for determining a coupling state between the device and another device, e.g. a signal strength of a wireless connection between the device and another device, or an electromechanical mechanism to detect the direct physical and/or electrical connection of the device to another device,
- a detector for detecting a separation distance between the device and another device, e.g. sensor remote of device that is a part of a separate device, such as a key fob of a key ring or detecting a reduction in signal strength of a wireless connection between the device and another device which is indicative of an increase of separation distance therebetween.

The device itself may comprise detectors or sensors for detecting movement and the ambient conditions and/or the device comprise an input/receiving means for receiving signals relating to measurements from such detectors or sensors.

The flowchart of FIG. 3 represents a possible method 300 that the apparatus 200, controller 201, processing circuitry 202, computer program 204 or device 211 may cause to be performed.

The process commences at block 301. At optional block 302 a reference value of at least one ambient condition is determined. This could simply correspond to a detected level of at least one ambient condition prior to the detection of movement in block 303 or, for example, a time averaged ambient condition. In block 303 a determination is made whether a detected movement meets one or more criterion, e.g. if the level of movement is greater than a threshold amount or if the detected movement matches a predetermined profile/sequence of movements. Optionally (not shown) a reference movement level could previously have be ascertained to establish a threshold level of movement.

If the detected movement does not meet the criterion, the process loops back to block 301. If the criterion is met, the process continues to block 304. In block 304 a determination is made as to whether a user is holding, touching or is in direct physical contact with the device. For example, a grip sensor, located at one or more positions of the housing of the device where a user would typical grasp the device during use, could be used in this regard. If the grip sensor were to detect an absence of a user's touch, this would be indicative of intentional movement of the device, e.g. a user's hand removing the device from the pocket. In which case the process loops back to block 301.

If it is determined that the user is not holding/touching the device the process continues to block 305 where it is determined whether or not one or more detected ambient conditions each meet a criterion. The criterion may relate to the determined reference ambient conditions of block 302, e.g. as a predetermined difference between the reference ambient condition and the detected ambient condition. If this criterion is not met, the process loops back to block 301 (or alternatively block 305 is repeated for another ambient condition). If the criterion is met, this causes a triggering of an alert in block 306 (or alternatively block 305 is repeated for another ambient condition). Thus, a determination as to whether or not to trigger the alert is based on a detected movement of the device and detected one or more ambient conditions, as well as optionally a detected one or more reference ambient conditions.

Furthermore, the determination as to whether or not to trigger the alert could be based on a determined context of the device in block 308. The context could comprise, not least, a location of the device or an activity of the device, e.g. determined from a user's calendar entry in a calendar software application. The determined context could be used to alter the weighting, criteria and thresholds used in the detected movement and ambient conditions. For example, where it is determined from a user's diary that he is scheduled to be on a bike ride, the threshold criterion for movement could be increased.

Moreover, the type of alert and its prominence (i.e. the degree of the alert such as its volume, brightness, vibration level/amplitude) may also vary in dependence upon the determined context. For example, where a determination is made that the device's current location corresponds to a location designated as 'home', in certain examples no alert may be triggered. Alternatively a more subtle/decreased level of alert could be triggered. By contrast, where a determination is made that the device's current location corresponds to a public location, the alert degree could be set to an increased level or maximum so as to seek to maximally alert the user as to the misplacement of the device and avoid its loss.

As indicated in block 307, the alert may comprise an audio, visual, of haptic alert such as output of a sound, visual (lights, image, displayed output) or vibration from the device itself to alert the user as to the fact that the device has undergone an unintentional movement. In one particular example where the apparatus is embodied in a device with a light, such as a flash or flashlight, the alert may comprises the continuous blinking of the flash light or a predetermined sequence of blinking of the flash light. Also, as shown in block 309, the alert may comprise causing or facilitating a transmission of a message, signal or communication to: another device (e.g. a predetermined device such as a wearable or mobile device of the user or a device of one or more designated contacts of the user), the user, a designated contact of the user, a remote server or the cloud. The message may comprise context information, e.g. a last known location of the device, such as determined in block 308.

The alert could comprise the display of a message or an output of user information, for example presenting contact information or instructions as to how to contact or notify the user (or one or more designated contacts of the user) on a display of the device so as to assist a person finding the device to contact or notify the user/designated contact person. Interactive user interface elements could be presented on the device that facilitate a person finding the device to contact or notify the user/designated contact person via the device itself, e.g. by making a phone call or transmitting a message/signal to another device via the device itself.

The alert could be outputted after a predetermined period of time has elapsed since the detected movement, and/or it could be periodically outputted upon pre-determined periods of time, thereby saving battery power. The alert could also be outputted upon a subsequent movement or ambient condition detection, such as detection of a person approaching or a detection and recognition of a user's voice.

One or more of: the detected movement, the detected ambient condition, and a context of the device could also be used to trigger controlling the device to effect other functions, for example automatically changing an operative condition/mode of the device (including overriding a user's previously manually set or disabled operative conditions/modes). Changing an operative condition/mode of the device may comprise:

- changing a volume or a notification profile. For example, where the device is a mobile phone in a 'silent' mode, this could be changed to a 'normal' mode such that a person calling the phone would be able to hear it ring when looking for it,
- changing the device to a locked operative mode, whereby unauthorised operation of the device is restricted/prevented. For example, the device may be placed into a limited operative mode whereby only communication to the user him/herself or one or more designated contact persons is permitted (or communication to other devices belonging to the user and the designated contact person), enabling/turning on a device's GPS sensor and/or positioning services to allow a user to locate the device, e.g. via a remote device location service presenting information or interactive user interface elements on the display for enabling a person who finds the device to contact or notify the user or another party. In this regard, the device could be caused to display a user interface with which a person who finds the device could interact to cause a message/signal to be sent to the user (or a designated at least one other person) and/or another device of the user (or the designated at least one other person). For example, the message/signal could be sent to a wearable device of the user which, responsive to the received message, itself provides an alert to the user such as via an audio, visual, or haptic output.

The triggering of an alert could comprise any one or more of the above.

The order of the blocks shown is not absolutely required, so in principle, the various blocks can be performed out of order. Not all the blocks are essential. In certain examples one or more steps may be performed in a different order or overlapping in time, in series or in parallel one or more steps may be omitted or added or changed in some combination of ways.

The blocks illustrated in FIGS. 1 and 3 may represent steps in a method and/or sections of instructions/code in the computer program 204.

Figure 4:
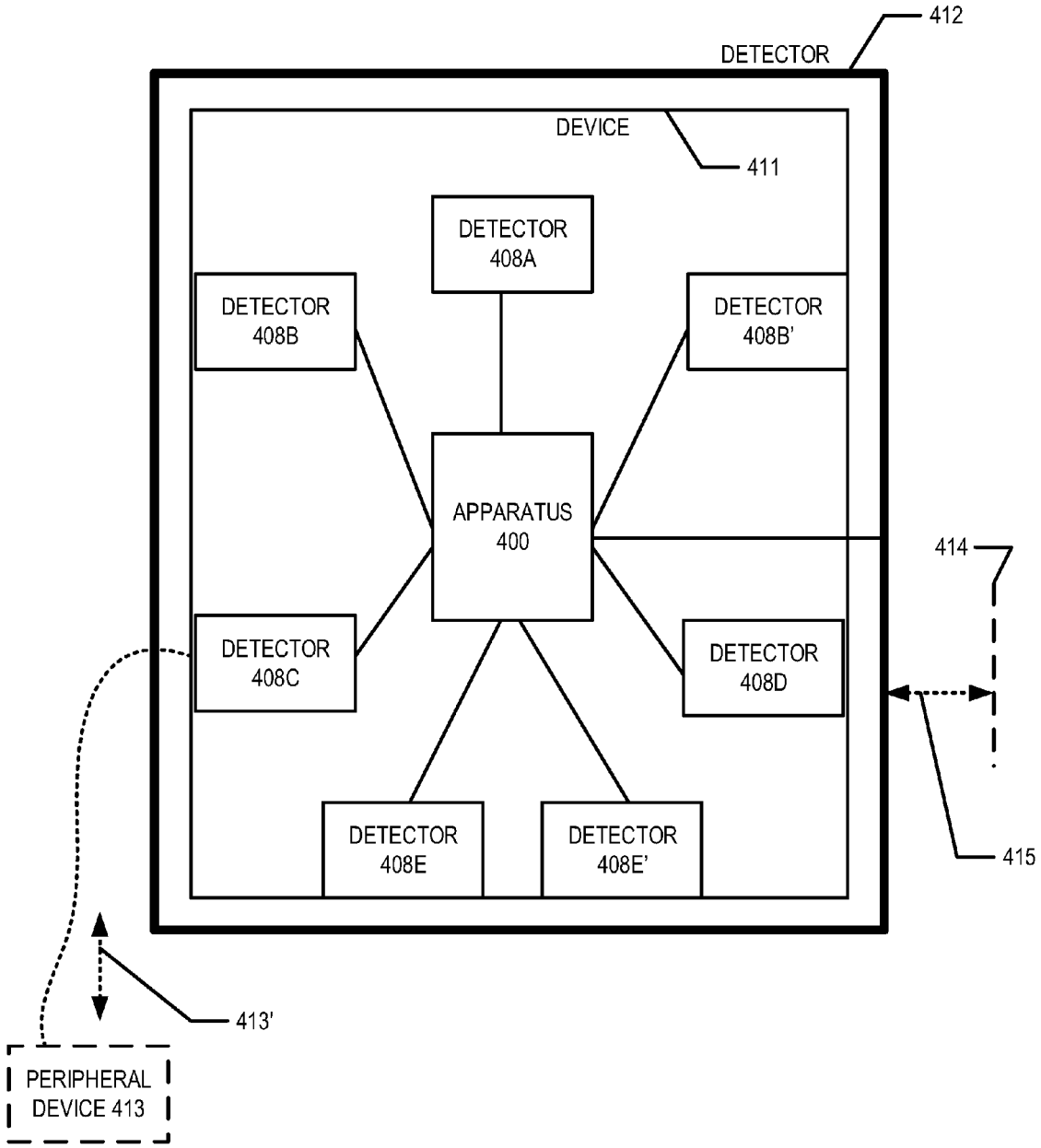
FIG. 4 schematically illustrates a device according to an example of the disclosure.

FIG. 4 schematically illustrates another device 411 according to an example of the disclosure. The device comprises an apparatus 400 similar to that described with regards to FIG. 2 and several detectors 408*a*-408*e*. At least one of the detectors 408*a* is configured to detect movement and the other detectors are configured to detect various of the previously mentioned ambient conditions.

The device also comprises a detector 412 to detect whether or not a user is holding the device or is in direct physical touch/contact with the device. Such a detector 412 may surround the device or comprise one or more grip sensors disposed at one or more peripheral edges or regions of the device, in particular at locations where a user hand would hold the device during typical use. The grip sensor 412 may be mechanically based, e.g. comprise a switch which is activated by the force of a user holding the device, or it could be electrically based, e.g. it could sense a change of capacitance upon a user's touch. The grip sensor may form part of the device or its external housing. Alternatively the grip sensor may form part of a releasably detachable cover/supplemental housing which at least partially covers the device, and which may also provide protection to the device against impacts. Such a separate cover may be configured to interface with the apparatus 400 to convey touch sensor signals to the apparatus. A determination as to whether or not to trigger an alert could be based on a detected absence of a user touching/holding/gripping the device.

At least two of the detectors 408*b* and 408*b*' are disposed on opposing sides of the device. The detectors may be configured to detect the same ambient condition, or differing ambient conditions, but from differing locations of the device. For example, the detectors 408*b* and 408*b*' may be in the form of light sensors in the form of a front facing camera 408*b* and a rear facing camera 408*b*'. A determination as to whether or not to trigger an alert could be based on a detected signal from one of the detectors 408*b* 408*b*'.

One of the detectors 408*c* may detect a connection state 413' between the device 411 and a separate device 413, e.g. a peripheral device or accessory such as headphones or Bluetooth headset. The detector may be able to detect a de-coupling, disconnection or detachment of the peripheral device 413 from the device 411. For example, a physical disconnection such as a headphone's jack coming out of a socket of the device, or wireless disconnection such as loss of a short range wireless connection following movement of the device 411 relative to the peripheral device 413. A determination as to whether or not to trigger an alert could be based on a detected decoupling of a peripheral device from the device.

One of the detectors 408*d* may be a proximity detector, able to detect an external object 414 being proximal to the device, i.e. within a short distance 415 of the device. A determination as to whether or not to trigger an alert could be based on a detected absence of a proximal object.

One of the detectors 408*e* may be configured to detect sound. The apparatus may further comprise a sound output device 408*e*', e.g. a speaker, controlled by the apparatus to output a sound. The detector 408*e* could detect the response to the output sound, e.g. any echo or reverberation. A determination as to whether or not to trigger an alert could be based on the detected response to the outputted sound. For example, the detection of the outputted sound could be processed to analyse its spectrum and ascertain aspects of an environment of the device, for example whether it is in an enclosed space, e.g. pocket, or an open space, e.g. lying face up on an un enclosed surface.

Figure 5A:
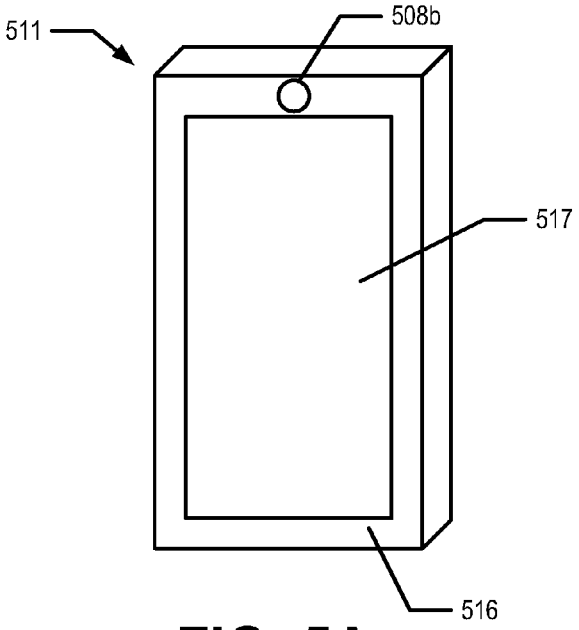
FIGS. 5A, 5B and 5C schematically illustrate a device according to a further example of the disclosure.
Figure 5B:
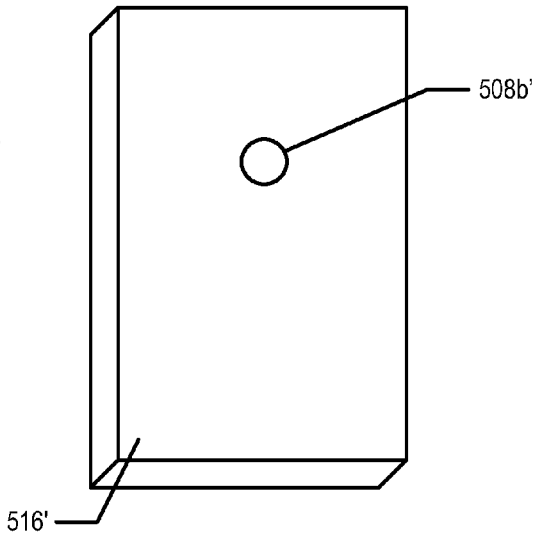
Figure 5C:
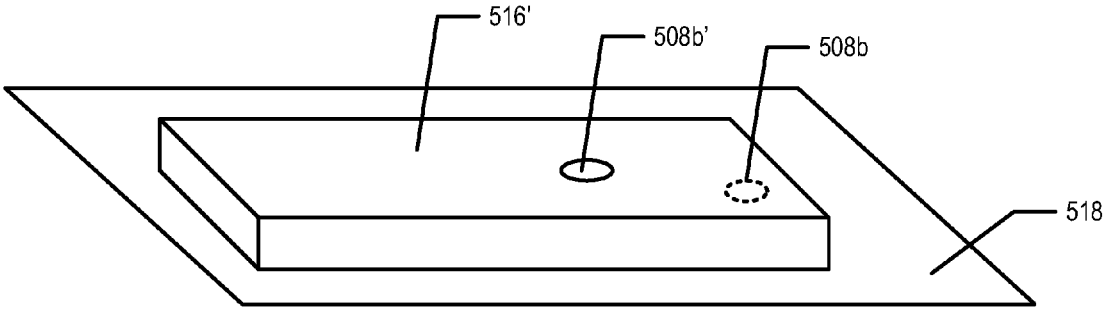

FIGS. 5A, 5B and 5C schematically illustrate a device 511 according to a further example of the disclosure. The device has opposing front 516 and rear 516' major surfaces. A display 517 is located on the front major surface. A first detector 508*b* is located on the front major surface and a second detector 508*b*' is located on the rear major surface. In this example, the detectors are for detecting and measuring light/luminosity and comprise light sensors in the form of CCD's of a front facing camera 508*b* and a rear facing camera 508*b*'.

In the situation where the device falls from a user's pocket onto a surface 518, prior to the fall within the pocket both cameras would detect low light levels. Following the fall, where the device is lying face down on the surface as shown in FIG. 5C, the front facing camera, obscured by the surface would still measure low light levels. The camera 508*b* would continue to detect a low light level and register no change following the fall. Thus it would not further aid the determination as to whether an intentional or unintentional movement has occurred. Accordingly, responsive to the front camera 508*b* providing an inconclusive ambient condition measurement reading, e.g. a reading which matches a reference ambient condition measurement such that it is unclear whether there has been a change in the ambient condition, the other camera 508*b*' located on the opposing side 516' of the device may be activated to detect the ambient condition from the other side of the device.

Alternatively, the controller could select which camera 508*b* or 508*b*' to activate responsive a measurement from another detector (not shown). For example, the another detector could be an orientation detector from whose orientation measurement it is possible to determine that the device is orientated such that it is lying face down on a surface. Responsive to this the controller could select just the rear facing camera 408*b*' to be activated for performing a detection (rather than needlessly activating the front facing camera 408*b*).

In various examples of the disclosure, the device may be embodied as a hand held portable electronic device, such as a mobile telephone or personal digital assistant. The device may provide one or more of: wireless communication, audio/text/video communication functions (e.g. tele-communication, video-communication, and/or text transmission (Short Message Service (SMS)/Multimedia Message Service (MMS)/emailing) functions), interactive/non-interactive viewing functions (e.g. web-browsing, navigation, TV/program viewing functions), music recording/playing functions (e.g. Moving Picture Experts Group-1 Audio Layer 3 (MP3) or other format and/or (frequency modulation/amplitude modulation) radio broadcast recording/playing), downloading/sending of data functions, image capture function (e.g. using a (e.g. in-built) digital camera), and gaming functions.

Although examples of the apparatus have been described above in terms of comprising various components, it should be understood that the components, e.g. detectors, may be embodied as or otherwise controlled by a corresponding processing element or processor of the apparatus. In this regard, each of the components described below may be one of more of any device, means or circuitry embodied in hardware, software or a combination of hardware and software that is configured to perform the corresponding functions of the respective components as described in greater detail below.

In the above description, the wording 'connect', 'couple' and 'communication' as well as their derivatives mean operationally connected/coupled/in communication. It should be appreciated that any number or combination of intervening components can exist (including no intervening components).

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

Examples of the present invention provide both a method and corresponding apparatus consisting of various modules or means that provide the functionality for performing the steps of the method. The modules or means may be implemented as hardware, or may be implemented as software or firmware to be performed by a computer processor. In particular, in the case of firmware or software, examples of the invention can be provided as a computer program product including a computer readable storage structure embodying computer program instructions (i.e. the software or firmware) thereon for performing by the computer processor.

The apparatus may be provided in a module. As used here 'module' refers to a unit or apparatus that excludes certain parts/components that would be added by an end manufacturer or a user.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Although various examples of the present invention have been described in the preceding paragraphs with reference to various examples, it should be appreciated that modifications to the examples given can be made without departing from the scope of the invention as claimed.

The term 'comprise' is used in this document with an inclusive not an exclusive meaning. That is any reference to X comprising Y indicates that X may comprise only one X or may comprise more than one X. If it is intended to use 'comprise' with an exclusive meaning then it will be made clear in the context by referring to "comprising only one" or by using "consisting".

In this brief description, reference has been made to various examples. The description of features or functions in relation to an example indicates that those features or functions are present in that example. The use of the term 'example' or 'for example' or 'may' in the text denotes, whether explicitly stated or not, that such features or functions are present in at least the described example, whether described as an example or not, and that they can be, but are not necessarily, present in some of or all other examples. Thus 'example', 'for example' or 'may' refers to a particular instance in a class of examples. A property of the instance can be a property of only that instance or a property of the class or a property of a sub-class of the class that includes some but not all of the instances in the class.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method comprising causing a processor to perform, at least in part, actions that result in:

detecting movement of a device;

determining that the movement of the device meets a movement criterion, the movement criterion being a particular profile of movement or particular sequence of movements;

in response to determining that the movement of the device meets the movement criterion, detecting a change in at least one ambient condition of the device, wherein detecting the change in the at least one ambient condition comprises detecting an ambient condition at a first side of the device and detecting the ambient condition at a second side of the device, the first side and the second side being different sides of the device; and determining whether to trigger an alert in dependence upon the detected movement and the detected at least one ambient condition.

2. The method as claimed in claim 1, wherein detecting the movement comprises detecting movement of the device whilst a user is not touching the device.

3. The method as claimed in claim 1, wherein the at least one ambient condition relates to one or more of:

a light level,
a sound level,
a temperature,
a humidity,
a gas or particle,
a pressure,
an orientation of the device,
a proximity of an object to the device,
whether or not a user is touching the device,
a coupling state between the device and another device, and
a separation distance between the device and another device.

4. The method as claimed in claim 1, further comprising causing, at least in part, actions that result in determining at least one reference ambient condition and wherein determining to trigger the alert is further based on the at least one determined reference ambient condition.

5. The method as claimed in claim 1, further comprising causing, at least in part, action that result in:

outputting a sound and detecting a response to the outputted sound; and
wherein determining to trigger the alert is further based upon the detected response.

6. The method as claimed in claim 1, further comprising causing, at least in part, actions that result in determining a context and wherein determining to trigger the alert is further based on the determined context.

7. The method as claimed in claim 1, further comprising causing, at least in part, actions that result in at least one or more of:

displaying a message;
sending a message;
transmitting a signal; and
displaying interactive user interface elements for enabling communication with a separate device.

8. The method as claimed in claim 1, wherein a prominence of the alert is based on at least one or more of:

the detected movement of the device;
the detected at least one ambient condition of the device; and
a determined context of the device.

9. The method as claimed in claim 1, further comprising changing an operative condition of the device in dependence upon at least one or more of:

the detected movement of the device;
the detected at least one ambient condition of the device; and
a determined context of the device.

10. An apparatus comprising: at least one processor; and at least one memory including computer program code;

wherein the at least one memory and the computer program code are configured to, with the at least one processor, cause the apparatus at least to perform:
detection of a movement of a device;
determining that the movement of the device meets a movement criterion, the movement criterion being a particular profile of movement or particular sequence of movements;
in response to determining that the movement of the device meets the movement criterion, detection of a change in at least one ambient condition of the device, wherein detecting the change in the at least one ambient condition comprises detecting an ambient condition at a first side of the device and detecting the ambient condition at a second side of the device, the first side and the second side being different sides of the device; and
determination whether to trigger an alert in dependence upon the detection of the movement and the detection of the at least one ambient condition.

11. The apparatus as claimed in claim 10, wherein the detection of the movement comprises detection of movement of the device without a user touch on the device.

12. The apparatus as claimed in claim 10, wherein the at least one ambient condition relates to one or more of:

a light level,
a sound level,
a temperature,
a humidity,
a gas or particle,
a pressure,
an orientation of the device,
a proximity of an object to the device,
whether or not a user is touching the device,
a coupling state between the device and another device, and
a separation distance between the device and another device.

13. The apparatus as claimed in claim 10, wherein the apparatus is caused to perform, at least in part, action that results in determination of at least one reference ambient condition and wherein the determination to trigger the alert is further based on the at least one determination of reference ambient condition.

14. The apparatus as claimed in claim 10, wherein the apparatus is caused to at least to perform action that results in:

output of a sound and a detection of a response to the output of the sound; and
wherein the determination to trigger the alert is further based upon the detection of the response.

15. The apparatus as claimed in claim 10, wherein the apparatus is caused to at least to perform action that results in a determination of a context and wherein the determination to trigger the alert is further based on the determination of the context.

16. The apparatus as claimed in claim 10, wherein the apparatus is caused to at least to perform action that results in at least one or more of:

display of a message;
sending of a message;
transmitting of a signal; and
display of an interactive user interface elements for enabling communication with a separate device.

17. The apparatus as claimed in claim 10, wherein the apparatus is caused to at least to perform action that result in a change of an operative condition of the device in dependence upon at least one or more of:

the detected movement of the device;
the detected at least one ambient condition of the device; and
a determined context of the device.

18. A non-transitory computer readable medium encoded with instructions that, when performed by at least one processor, cause at least the following to be performed:

detecting movement of a device;
determining that the movement of the device meets a movement criterion, the movement criterion being a particular profile of movement or particular sequence of movements;

in response to determining that the movement of the device meets the movement criterion, detecting a change in at least one ambient condition of the device, wherein detecting the change in the at least one ambient condition comprises detecting an ambient condition at a first side of the device and detecting the ambient condition at a second side of the device, the first side and the second side being different sides of the device; and determining whether to trigger an alert in dependence upon the detected movement and the detected at least one ambient condition.

* * * * *